US006950794B1

(12) United States Patent
Subramaniam et al.

(10) Patent No.: US 6,950,794 B1
(45) Date of Patent: Sep. 27, 2005

(54) FEEDFORWARD PREDICTION OF SCALEFACTORS BASED ON ALLOWABLE DISTORTION FOR NOISE SHAPING IN PSYCHOACOUSTIC-BASED COMPRESSION

(75) Inventors: Girish P. Subramaniam, Austin, TX (US); Raghunath K. Rao, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 649 days.

(21) Appl. No.: 09/989,322

(22) Filed: Nov. 20, 2001

(51) Int. Cl.[7] ..... G10L 19/00

(52) U.S. Cl. ..... 704/200.1; 704/230; 704/500

(58) Field of Search ..... 704/206, 230, 704/229, 500, 200.1, 224–225; 369/59.16

(56) References Cited

U.S. PATENT DOCUMENTS

| | | | | |
|---|---|---|---|---|
| 5,654,952 | A * | 8/1997 | Suzuki et al. | 369/59.16 |
| 5,781,452 | A | 7/1998 | Lee et al. | 364/572 |
| 5,794,181 | A | 8/1998 | Benbassat et al. | 704/212 |
| 5,867,819 | A | 2/1999 | Fukuchi et al. | 704/500 |
| 5,946,652 | A * | 8/1999 | Heddle | 704/230 |
| 6,041,295 | A * | 3/2000 | Hinderks | 704/206 |
| 6,104,996 | A | 8/2000 | Yin | 704/500 |
| 6,295,009 | B1 | 9/2001 | Goto | 341/50 |
| 6,456,968 | B1 * | 9/2002 | Taniguchi et al. | 704/229 |
| 6,725,192 | B1 * | 4/2004 | Araki | 704/230 |

OTHER PUBLICATIONS

ISO/IEC 11172-3, "Information Technology—Coding of Moving Pictures and Associated Audio for Digital Storage Media At Up to About 1,5 Mbit/s-", International Electrotechnical Commission, Aug., 1993.

* cited by examiner

*Primary Examiner*—David L. Ometz
*Assistant Examiner*—Huyen X. Vo
(74) *Attorney, Agent, or Firm*—Steven Lin, Esq.

(57) ABSTRACT

A method of encoding a digital signal, particularly an audio signal, which predicts favorable scalefactors for different frequency subbands of the signal. Distortion thresholds which are associated with each of the frequency subbands of the signal are used, along with transform coefficients, to calculate total scaling values, one for each of the frequency subbands, such that the product of a transform coefficient for a given subband with its respective total scaling value is less than a corresponding one of the distortion thresholds. In an audio encoding application, the distortion thresholds are based on psychoacoustic masking. The invention may use a novel approximation for calculating the total scaling values, which obtains a first term based on a corresponding distortion threshold, and obtains a second term based on a sum of the transform coefficients. Both of these terms may be obtained using lookup tables. The total scaling values can be normalized to yield scalefactors by identifying one of the total scaling values as a minimum nonzero value, and using that minimum nonzero value to carry out normalization. Encoding of the signal further includes the steps of setting a global gain factor to this minimum nonzero value, and quantizing the transform coefficients using the global gain factor and the scalefactors.

30 Claims, 6 Drawing Sheets

FEEDFORWARD PREDICTION OF SCALEFACTORS BASED ON ALLOWABLE DISTORTION FOR NOISE SHAPING IN PSYCHOACOUSTIC-BASED COMPRESSION

BACKGROUND OF THE INVENTION

1. Field of the Invention

The present invention generally relates to digital processing, specifically audio encoding and decoding, and more particularly to a method of encoding and decoding audio signals using psychoacoustic-based compression.

2. Description of the Related Art

Many audio encoding technologies use psychoacoustic methods to code audio signals in a perceptually transparent fashion. Due to the finite time-frequency resolution of the human auditory anatomy, the ear is able to perceive only a limited amount of information present in the stimulus. Accordingly, it is possible to compress or filter out portions of an audio signal, effectively discarding that information, without sacrificing the perceived quality of the reconstructed signal.

One audio encoder which uses psychoacoustic compression is the MPEG-1 Layer 3 (also referred to as "MP3"). MPEG is an acronym for the Moving Pictures Expert Group, an industry standards body created to develop comprehensive guidelines for the transmission of digitally encoded audio and video (moving pictures) data. MP3 encoding is described in detail ISO/IEC 11172-3, *Information Technology—Coding of Moving Pictures and Associated Audio for Digital Storage Media at up to about* 1.5 *Mbit/s*—which is incorporated by reference herein in its entirety. There are currently three "layers" of audio encoding in the MPEG-1 standard, offering increasing levels of compression at the cost of higher computational requirements. The standard supports three sampling rates of 32, 44.1 and 48 kHz, and output bit rates between 32 and 384 kbits/sec. The transmission can be mono, dual channel (e.g., bilingual), stereo, or joint stereo (where the redundancy or correlations between the left and right channels can be exploited).

MPEG Layer 1 is the lowest encoder complexity, using a 32 subband polyphase analysis filterbank, and a 512-point fast Fourier transform (FFT) for the psychoacoustic model. The optimal bit rate per channel for MPEG Layer 1 is at least 192 kbits/sec. Typical data reduction rates (for stereo signals) are about 4 times. The most common application for MPEG Layer 1 is digital compact cassettes (DCCs).

MPEG Layer 2 has moderate encoder complexity using a 1024-point FFT for the psychoacoustic model and more efficient coding of side information. The optimal bit rate per channel for MPEG Layer 2 is at least 128 kbits/sec. Typical data reduction rates (for stereo signals) are about 6–8 times. Common applications for MPEG Layer 2 include video compact discs (V-CDs) and digital audio broadcast.

MPEG Layer 3 has the highest encoder complexity applying a frequency transform to all subbands for increased resolution and allowing for a variable bit rate. Layer 3 (sometimes referred to as Layer III) combines attributes of both the MUSICAM and ASPEC coders. The coded bit stream can provide an embedded error-detection code by way of cyclical redundancy checks (CRC). The encoding and decoding algorithms are asymmetrical, that is, the encoder is more complicated and computationally expensive than the decoder. The optimal bit rate per channel for MPEG Layer 3 is at least 64 kbits/sec. Typical data reduction rates (for stereo signals) are about 10–12 times. One common application for MPEG Layer 3 is high-speed streaming using, for example, an integrated services digital network (ISDN).

The standard describing each of these MPEG-1 layers specifies the syntax of coded bit streams, defines decoding processes, and provides compliance tests for assessing the accuracy of the decoding processes. However, there are no MPEG-1 compliance requirements for the encoding process except that it should generate a valid bit stream that can be decoded by the specified decoding processes. System designers are free to add other features or implementations as long as they remain within the relatively broad bounds of the standard.

The MP3 algorithm has become the de facto standard for multimedia applications, storage applications, and transmission over the Internet. The MP3 algorithm is also used in popular portable digital players. MP3 takes advantage of the limitations of the human auditory system by removing parts of the audio signal that cannot be detected by the human ear. Specifically, MP3 takes advantage of the inability of the human ear to detect quantization noise in the presence of auditory masking. A very basic functional block diagram of an MP3 audio coder/decoder (codec) is illustrated in FIGS. 1A and 1B.

The algorithm operates on blocks of data. The input audio stream to the encoder 1 is typically a pulse-code modulated (PCM) signal which is sampled at or more than twice the highest frequency of the original analog source, as required by Nyquist's theorem. The PCM samples in a data block are fed to an analysis filterbank 2 and a perceptual model 3. Filterbank 2 divides the data into multiple frequency subbands (for MP3, there are 32 subbands which correspond in frequency to those used by Layer 2). The same data block of PCM samples is used by perceptual model 3 to determine a ratio of signal energy to a masking threshold for each scalefactor band (a scalefactor band is a grouping of transform coefficients which approximately represents a critical band of human hearing). The masking thresholds are set according to the particular psychoacoustic model employed. The perceptual model also determines whether the subsequent transform, such as a modified discrete cosine transform (MDCT), is applied using short or long time windows. Each subband can be further subdivided; MP3 subdivides each of the 32 subbands into 18 transform coefficients for a total of 576 transform coefficients using an MDCT. Based on the masking ratios provided by the perceptual model and the available bits (i.e., the target bit rate), bit/noise allocation, quantization and coding unit 4 iteratively allocates bits to the various transform coefficients so as to reduce to the audibility of the quantization noise. These quantized subband samples and the side information are packed into a coded bit stream (frame) by bitpacker 5 which uses entropy coding. Ancillary data may also be inserted into the frame, but such data reduces the number of bits that can be devoted to the audio encoding. The frame may additionally include other bits, such as a header and CRC check bits.

As seen in FIG. 1B, the encoded bit stream is transmitted to a decoder 6. The frame is received by a bit stream unpacker 7, which strips away any ancillary data and side information. The encoded audio bits are passed to a frequency sample reconstruction unit 8 which deciphers and extracts the quantized subband values. Synthesis filterbank 9 is then used to restore the values to a PCM signal.

FIG. 2 further illustrates the manner in which the subband values are determined by bit/noise allocation, quantization and coding unit 4 as prescribed by ISO/IEC 11172-3. Initially, a scalefactor of unity (1.0) is set for each scalefactor band at block 10. Transform coefficients are provided by the frequency domain transform of the analog samples at block 11 using, for example, an MDCT. The initial scalefactors are then respectively applied at block 12 to the transform coefficients for each scalefactor band. A global gain factor is then set to its maximum possible value at block 13. The total gain for a particular scalefactor band is the global gain combined with the scalefactor for that particular scalefactor band. The global gain is applied in block 14 to each of the scalefactor bands, and the quantization process is then carried out for each scalefactor band at block 15. Quantization rounds each amplified transform coefficient to the nearest integer value. A calculation is performed in block 16 to determine the number of bits that are necessary to encode the quantized values, typically based on Huffman encoding. For example, with a target bit rate of 128 kbps and a sampling frequency of 44.1 kHz, a stereo-compressed MP3 frame has about 3344 bits available, of which 3056 can be used for audio signal encoding while the remainder are used for header and side information. If the number of bits required is greater than the number available as determined in block 17, the global gain is reduced in block 18. The process then repeats iteratively beginning with block 14. This first or "inner" loop repeats until an appropriate global gain factor is established which will comport with the number of available bits.

Once an appropriate global gain factor is established by the inner loop, the distortion for each scalefactor band (sfb) is calculated at block 19. As seen in block 20, if the distortion values are less than the respective thresholds set by the mask of the perceptual model 3 being used, e.g., Psychoacoustic Model 2 as described in ISO/IEC 11172-3, then the quantization/allocation process is complete at block 22, and the bit stream can be packed for transmission. However, if any distortion value is greater than its respective threshold, the corresponding scalefactor is increased at block 21, and the entire process repeats iteratively beginning with step 12. This second or "outer" loop repeats until appropriate distortion values are calculated for all scalefactor bands. The re-execution of the outer loop necessarily results in the re-execution of the inner, nested loop as well. In other words, even though a global gain factor was already calculated by the inner loop in a previous iteration, that factor will be discarded when the outer loop repeats, and the global gain factor will be reset to the maximum at step 13. In this manner, the Layer III encoder 1 quantizes the spectral values by allocating just the right number of bits to each subband to maintain perceptual transparency at a given bit rate.

The outer loop is known as the distortion control loop while the inner loop is known as the rate control loop. The distortion control loop shapes the quantization noise by applying the scalefactors in each scalefactor band while the inner loop adjusts the global gain so that the quantized values can be encoded using the available bits. This approach to bit/noise allocation in quantization leads to several problems. Foremost among these problems is the excessive processing power that is required to carry out the computations due to the iterative nature of the loops, particularly since the loops are nested. Moreover, increasing the scalefactors does not always reduce noise because of the rounding errors involved in the quantization process and also because a given scalefactor is applied to multiple transform coefficients in a single scalefactor band. Furthermore, although the process is iterative, it does not use a convergent solution. Thus, there is no limit to the number of iterations that may be required (for real-time implementations, the process is governed by a time-out). This computationally intensive approach has the further consequence of consuming more power in an electronic device. It would, therefore, be desirable to devise an improved method of quantizing frequency domain values which did not require excessive iterations of scalefactor calculations. It would be further advantageous if the method could be easily implemented in either hardware or software.

SUMMARY OF THE INVENTION

It is therefore one object of the present invention to provide an improved method of encoding digital signals.

It is another object of the present invention to provide such an improved method which encodes an audio signal using a psychoacoustic model to compress the digital bit stream.

It is yet another object of the present invention to provide a method of predicting favorable scalefactors used to quantize an audio signal.

The foregoing objects are achieved in methods and devices for determining scalefactors used to encode a signal generally involving associating a plurality of distortion thresholds with a respective plurality of frequency subbands of the signal, transforming the signal to yield a plurality of transform coefficients, one for each of the frequency subbands, and calculating a plurality of total scaling values, one for each of the frequency subbands, such that the product of a transform coefficient for a given subband with its respective total scaling value is less than a corresponding one of the distortion thresholds. The methods and devices are particularly useful in processing audio signals which may originate from an analog source, in which case the analog signal is first converted to a digital signal. In such an audio encoding application, the distortion thresholds are based on psychoacoustic masking.

In one implementation, the invention uses a novel approximation for calculating the total scaling values, which obtains a first term based on a corresponding distortion threshold and obtains a second term based on a sum of the transform coefficients. Both of these terms may be obtained using lookup tables. In calculating a given total scaling value $A_{sfb}$ for a particular frequency subband, the methods and devices may use the specific formula:

$$A_{sfb}=2[4/(9BW_{sfb})]^{2/3}*(1/M_{sfb})^{2/3}*(\Sigma x_i)^{1/3},$$

where $BW_{sfb}$ is the bandwidth of the particular frequency subband, $M_{sfb}$ is the corresponding distortion threshold, and $\Sigma x_i$ is the sum of all of the transform coefficients. The total scaling values can be normalized to yield a respective plurality of scalefactors, one for each subband, by identifying one of the total scaling values as a minimum nonzero value and using that minimum nonzero value to carry out normalization. Encoding of the signal further includes the steps of setting a global gain factor to this minimum nonzero value and quantizing the transform coefficients using the global gain factor and the scalefactors. The number of bits required for quantization is computed and compared to a predetermined number of available bits. If the number of required bits is greater than the predetermined number of available bits, then the global gain factor is reduced, and the transform coefficients are re-quantized using the reduced global gain factor and the scalefactors.

The above as well as additional objectives, features, and advantages of the present invention will become apparent in the following detailed written description.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1A:
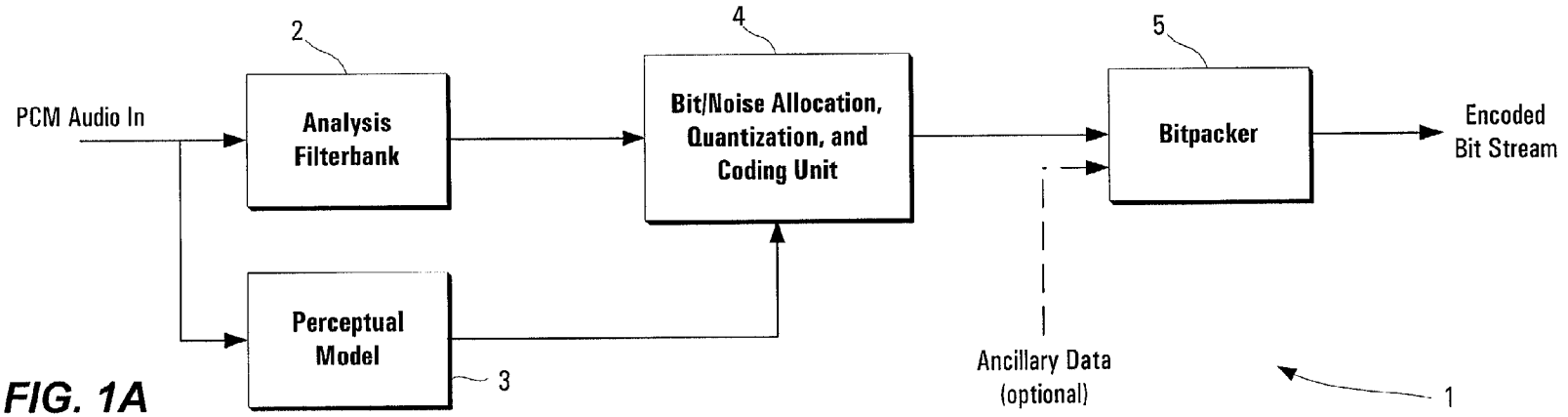
FIG. 1A Prior Art
FIG. 1A is a high-level block diagram of a prior art conventional digital audio encoder such as an MPEG-1 Layer 3 encoder which uses a psychoacoustic model to compress the audio signal during quantization and packs the encoded audio bits with side information and ancillary data to create an output bit stream.
Figure 1B:
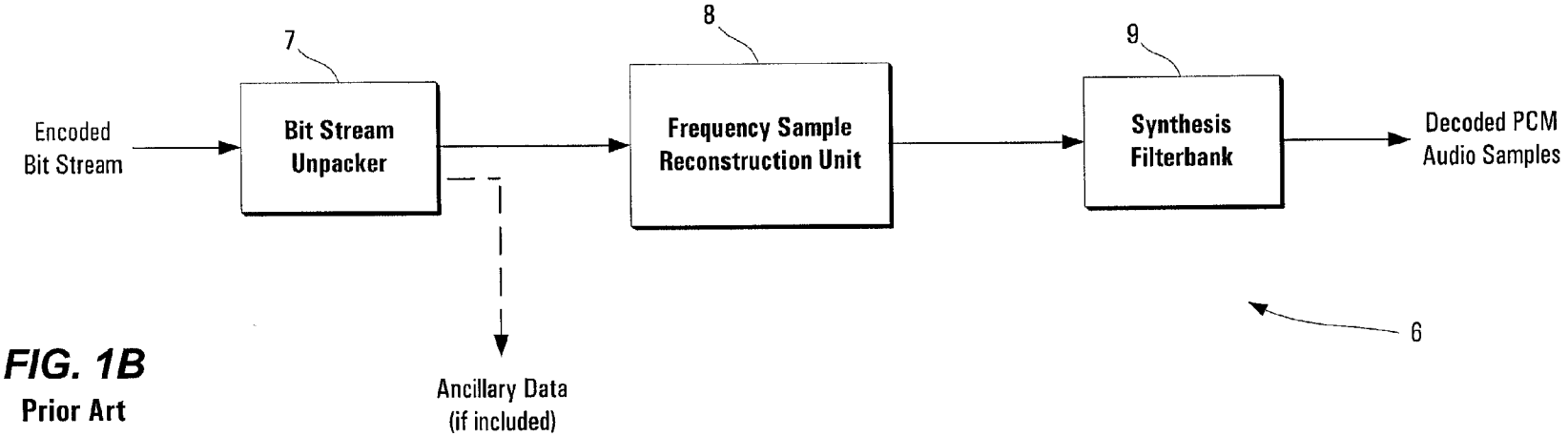
FIG. 1B Prior Art
FIG. 1B is a high-level block diagram of a prior art conventional digital audio decoder which is adapted to process the output bit stream of the encoder of FIG. 1A, such as an MPEG-1 Layer 3 decoder.

The present invention is directed to an improved method of encoding digital signals, particularly audio signals which can be compressed using psychoacoustic methods. The invention utilizes a feedforward scheme which attempts to predict an optimum or favorable scalefactor for each subband in the audio signal. In order to understand the prediction mechanism of the present invention, it is useful to review the quantization process. The following description is provided for an MP3 framework, but the invention is not so limited and those skilled in the art will appreciate that the prediction mechanism may be implemented in other digital encoding techniques which utilize scalefactors for different frequency subbands.

In general, a transform coefficient x that is to be quantized is initially a value between zero and one (0,1). If A is the total scaling that is applied to x before quantization, the value of A is the sum total scaling applied on the transform coefficient including pre-emphasis, scalefactor scaling, and global gain. These terms may be further understood by referencing the ISO/IEC standard 11172-3. Once the scaling is applied, a nonlinear quantization is performed after raising the scale value to its ¾ power. Thus, the final quantized value ix can be represented as:

$ix=\text{nint}[(Ax)^{3/4}]$, where $A=2^{[(gg/4)+sf+pe]}$, gg=global gain exponent, sf=scalefactor exponent, pe=pre-emphasis exponent, and nint( ) in the nearest integer operation.

The foregoing equation is a simplification of the equation from ISO/IEC 11172-3 specification that may be utilized without distorting the essence of the implementation.

The value of ix is then encoded and sent to the decoder along with the scaling factor A. At the decoder the reverse operation is performed and the transform coefficient is recovered as $x'=[(ix)^{4/3}]/A$ .

The present invention takes advantage of the fact that the maximum noise that can occur due to quantization in the scaled domain is 0.5 (the maximum error possible in rounding the scaled value to the nearest integer). This observation can be expressed by the equation:

$$\max\{abs[ix-(Ax)^{3/4}]\}=0.5.$$

An inverse operation can be performed on this equation to predict appropriate scale factors. Considering the worst case (where the distortion is 0.5) and defining $y=(Ax)^{3/4}$, then $ix=y+0.5$. The difference may then be computed between $(y+0.5)^{4/3}$ and $y^{4/3}$. By Taylor series approximation, $$(y+0.5)^{4/3}=y^{4/3}+(4/3)(0.5)y^{1/3}+(4/9)(0.5)^2y^{-2/3}+\ldots$$

Ignoring higher order terms, this equation can be rewritten as:

$$(y+0.5)^{4/3}-y^{4/3}=(4/3)(0.5)y^{1/3}=(2/3)y^{1/3}=(2/3)(Ax)^{1/4}$$

To obtain the maximum error (e) in the transform coefficient domain, this difference is scaled by 1/A:

$$e=[(y+0.5)^{4/3}-y^{4/3}]/A=(2/3)x^{1/4}A^{-3/4}.$$

To find the average distortion in a scalefactor band, the distortion for each transform coefficient is squared and summed and the total divided by the number of coefficients in that band. Thus, the maximum average distortion for a scalefactor band can be written as:

$$E=[(2/3)^2A^{-3/2}/BW_{sfb}]*\Sigma x_i^{1/2},$$

where $BW_{sfb}$ is the bandwidth of the particular scalefactor band (the bandwidth is the number of transform coefficients in a given scalefactor band). Since the maximum allowed distortion for each scalefactor band is known ($M_{sfb}$, from the psychoacoustic model), and since the values of the transform coefficients are known, the value of the total scaling (A) that is required to shape the noise to approach the maximum allowed noise can be derived. The value of A for a particular scalefactor band is accordingly computed as: which can be further approximated as:

$$A_{sfb}=\{[4/(9M_{sfb}BW_{sfb})]*\Sigma x_i^{1/2}\}^{2/3},$$

which can be further approximated as:

$$A_{sfb}=\{[4/(9M_{sfb}BW_{sfb})]^{2/3}*2(\Sigma x_i)^{1/3}=2[4/(9BW_{sfb})]^{2/3}*(1/M_{sfb})^{2/3}*(\Sigma x_i)^{1/3}.$$

$A_{sfb}$ would, however, be clamped at a minimum value of 1.0. This equation represents a heuristic approximation which works well in practice. In this last equation, it should be noted that the first term is a constant value, the second term can be looked up in a table, and the third term involves the addition of the transform coefficients, followed by a lookup in another table. This computational technique is thus very simple (and inexpensive) to implement. The scalefactors are predicted based on the allowable distortion and actual signal energies.

Once the value of $A_{sfb}$ has been derived for all scalefactor bands, they can be normalized with respect to the minimum value of all of the derived values (which would be nonzero since $A_{sfb}$ is clamped at a minimum value of one). Normalization provides the values with which each scalefactor band is to be amplified before performing the global amplification, i.e., the scalefactors themselves. The minimum value of all the derived A values is the global gain. If this initially determined global gain satisfies the bit constraint, then the distortion in all scalefactor bands is guaranteed to be less than the allowed values.

The above analysis is conservative in that it assumes a worst case error of 0.5 in every quantized output. In practice, it can be shown that the worst case error is closer to the order of 0.25, which can lead to a slightly different computation. The scalefactors can still be decreased one at a time until the bit constraint is met. Although the predicted scalefactors may not be optimum, they are more favorable statistically than using an initial scalefactor value of unity (zero scaling) as is practiced in the prior art.

Figure 3:
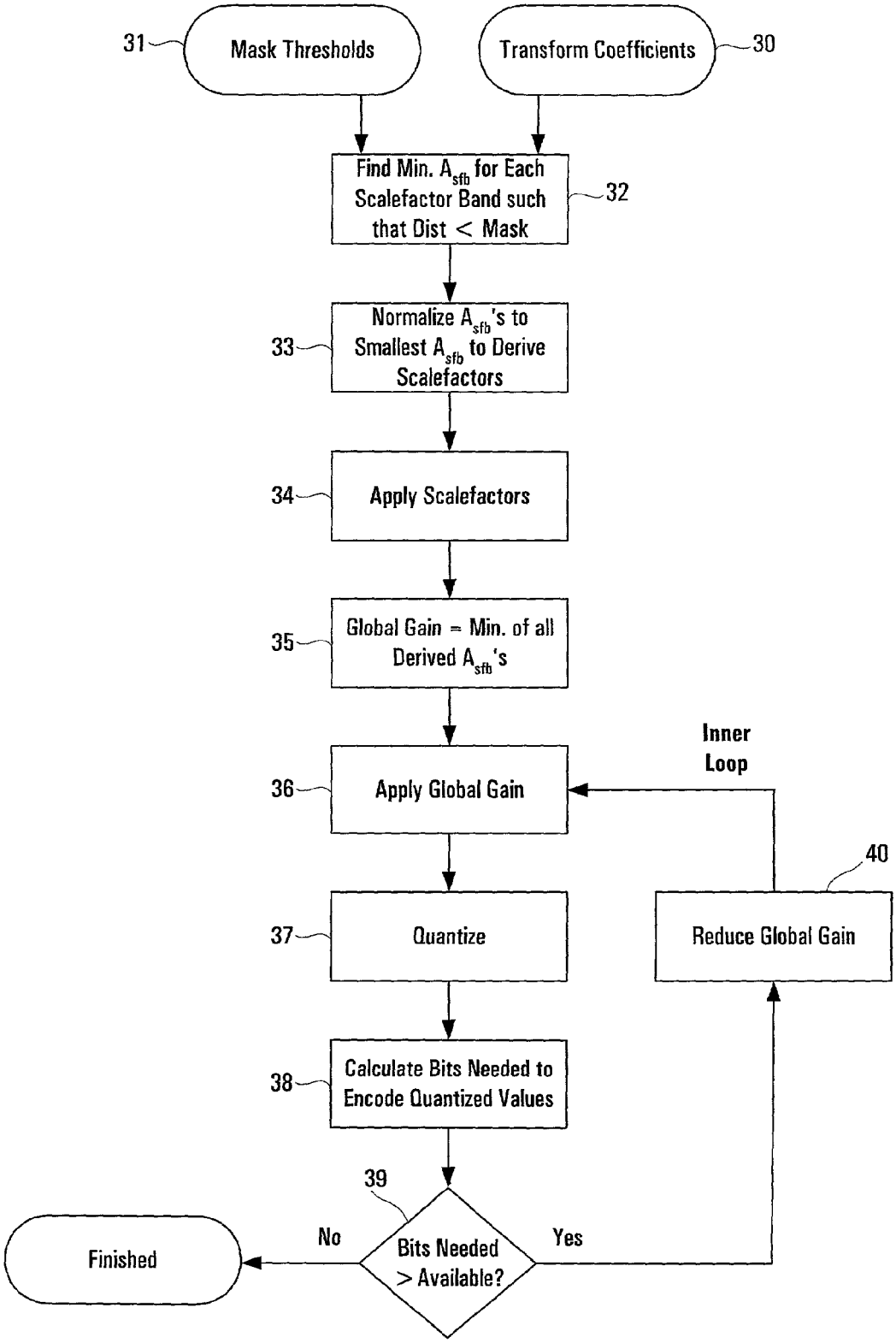
FIG. 3 is a chart illustrating the logical flow of an exemplary quantization process according to the present invention, in which favorable scalefactors for different subbands of the audio signal are predicted based on allowable distortion levels and actual signal energies.

With reference now to FIG. 3, a chart illustrating the logical flow according to one implementation of the present invention is depicted. The process begins by receiving the transform coefficients provided by the frequency domain transform (e.g., MDCT) of the analog samples at block 30, and by receiving the predetermined masking thresholds provided by the psychoacoustic model at block 31. The analog samples may be digitized by, e.g., an analog-to-digital converter. At block 32 these values are inserted into the foregoing equation to find the minimum scaling ($A_{sfb}$) required for each scalefactor band such that the distortion for a given band is less than the corresponding mask value. Each of the total scaling values $A_{sfb}$ (for MP3, 21 scalefactor bands) are examined to find the minimum scaling value, which is used to normalize all other total scaling values and yield the scalefactors at block 33. These scalefactors are then respectively applied to the transform coefficients for each subband at block 34. The global gain exponent is then set to correspond to the minimum $A_{sfb}$ value in block 35. The global gain is applied to each of the subbands in block 36, and the quantization process is then carried out for each subband at block 37 by rounding each amplified transform coefficient to the nearest integer value. In block 38, a calculation is performed to determine the number of bits that are necessary to encode the quantized values for MP3 based on the Huffman encoding scheme used by the standard. If the number of bits required is greater than the number available as determined in block 39, the global gain exponent is reduced by one at block 40. The process then repeats iteratively beginning with step 36. This loop repeats until an appropriate global gain factor is established which will comport with the number of available bits. If the number of bits required is not greater than the number available, then the process is finished.

Once an appropriate global gain factor is established by this (inner) loop, the process is complete. In other words, the present invention effectively removes the "outer" loop and the recalculation of distortion for each scalefactor band. This approach has several advantages. Because this approach does not require the iterations of the outer loop, it is much faster than prior art encoding schemes and consequently requires less power. Moreover, if the number of bits required to quantize the coefficients based on the initial global gain setting (the minimum $A_{sfb}$) is within the bit constraint, then the inner loop does not even iterate, i.e., the process is completed in one shot and the encoded bits can be immediately packed into the output frame.

Figure 2:
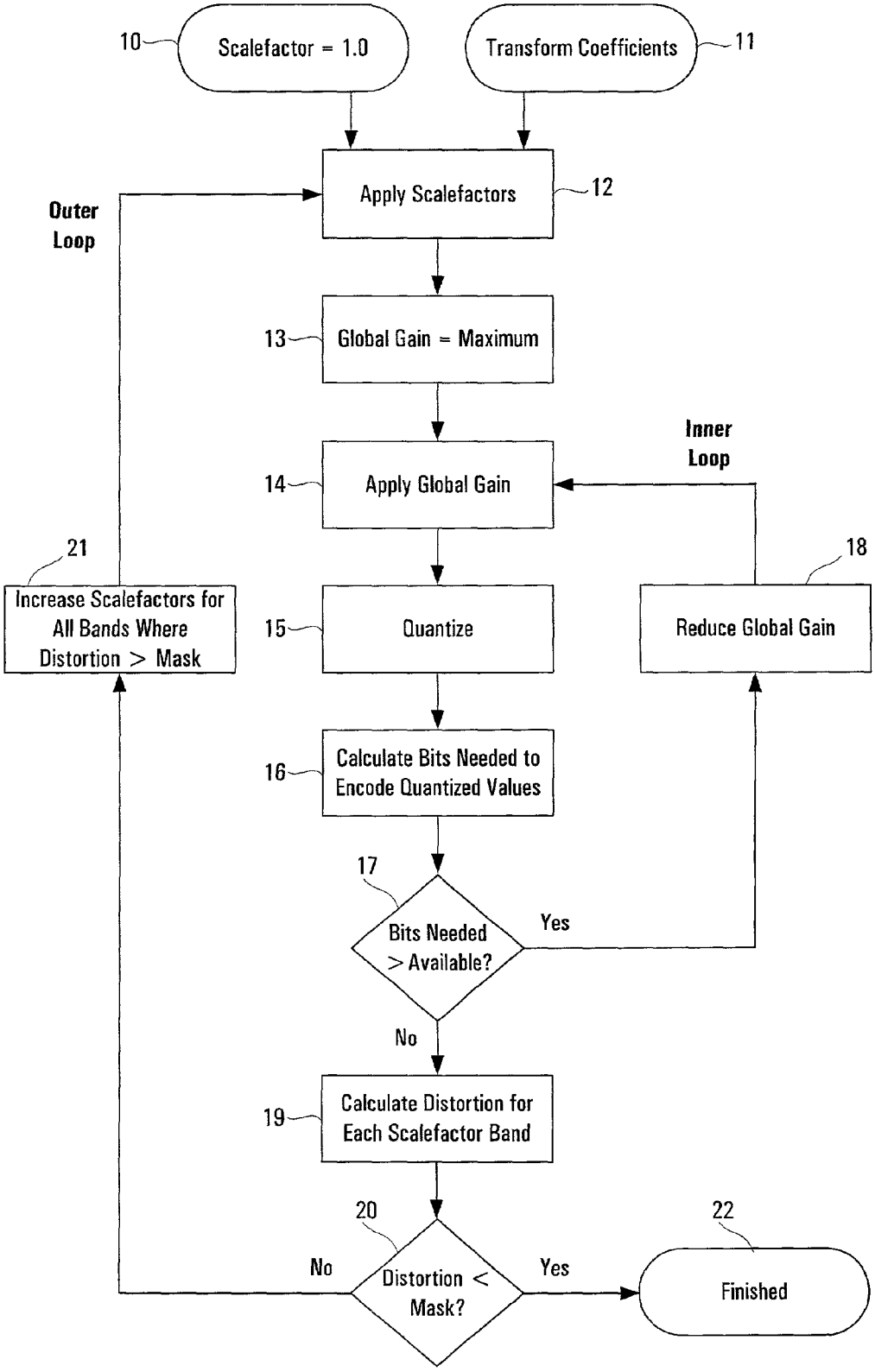
FIG. 2 Prior Art
FIG. 2 is a chart illustrating the logical flow of a quantization process according to the prior art which uses an outer iterative loop as a distortion control loop and an inner (nested) iterative loop as a rate control loop, wherein the outer loop establishes suitable scalefactors for different subbands of the audio signal and the inner loop establishes a suitable global gain factor for the audio signals.
Figure 4:
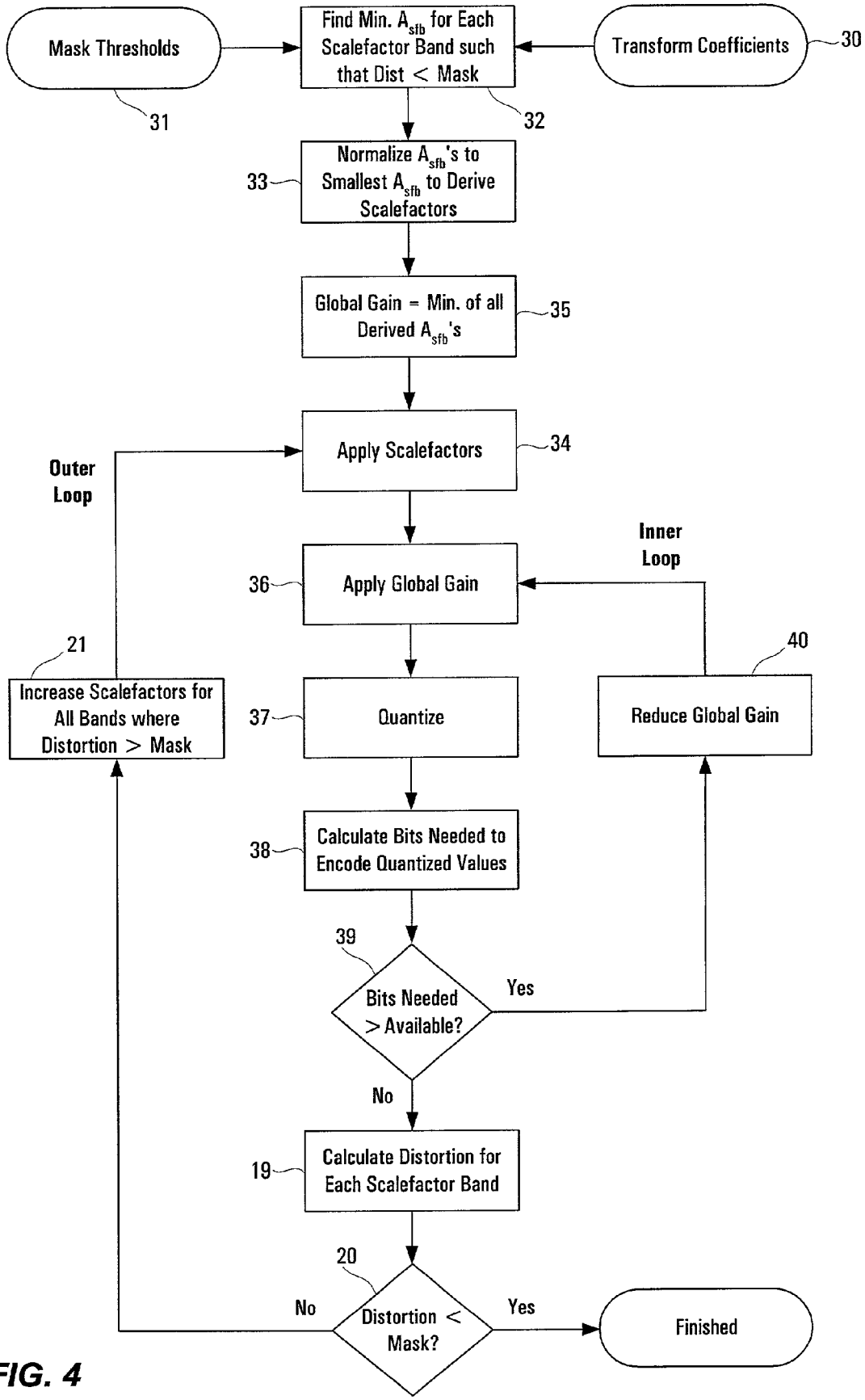
FIG. 4 is a chart illustrating the logical flow of another exemplary quantization process according to the present invention.

The techniques of the present invention can also be used to enhance the encoding performance of conventional inner/outer (i.e., rate/distortion) loop configured encoders such as the encoding scheme illustrated in FIG. 2. FIG. 4 illustrates such an implementation where the predicted scalefactors and global gain are used as the starting state of the conventional inner/outer loop scheme. Thus, the process begins at blocks 30 and 31 by receiving the transform coefficients of the analog samples and the predetermined masking thresholds provided by the psychoacoustic model. At block 33, the minimum scaling ($A_{sfb}$) required for each scalefactor band is determined such that the distortion for a given band is less than the corresponding mask value. Each of the total scaling values $A_{sfb}$ are examined to find the minimum scaling value, which is used to normalize all other total scaling values and yield the scalefactors at block 33. The global gain exponent is then set to correspond to the minimum $A_{sfb}$ value at block 35. These scalefactors are then respectively applied to the transform coefficients for each subband at block 34 and the global gain is applied to each of the subbands at block 36. As shown in FIG. 4, the inner loop reuses the most recent calculated global gain, rather than the maximum value as shown in FIG. 2.

The quantization process is then carried out for each subband at block 37 by rounding each amplified transform coefficient to the nearest integer value. At block 38 a calculation is performed to determine the number of bits that are necessary to encode the quantized values, and if the number of bits required is greater than the number available as determined in block 39, the global gain exponent is reduced by one at block 40. The process then repeats iteratively beginning with step 36. This loop repeats until an appropriate global gain factor is established which will comport with the number of available bits.

If the number of bits required is not greater than the number available as determined in block 39, the distortion for each scalefactor band is calculated at block 19. If the distortion values are less than the respective thresholds set by the mask of the perceptual model being used, as determined in block 20, the quantization/allocation process is complete and the bit stream can be packed for transmission. If any distortion value is greater than its respective threshold, the corresponding scalefactor is increased at block 21, and the entire process repeats iteratively beginning with step 34.

This combined feedforward/feedback scheme results in faster convergence to a better solution (e.g., less distortion) due to the improved starting conditions of the convergence process.

Figure 5:
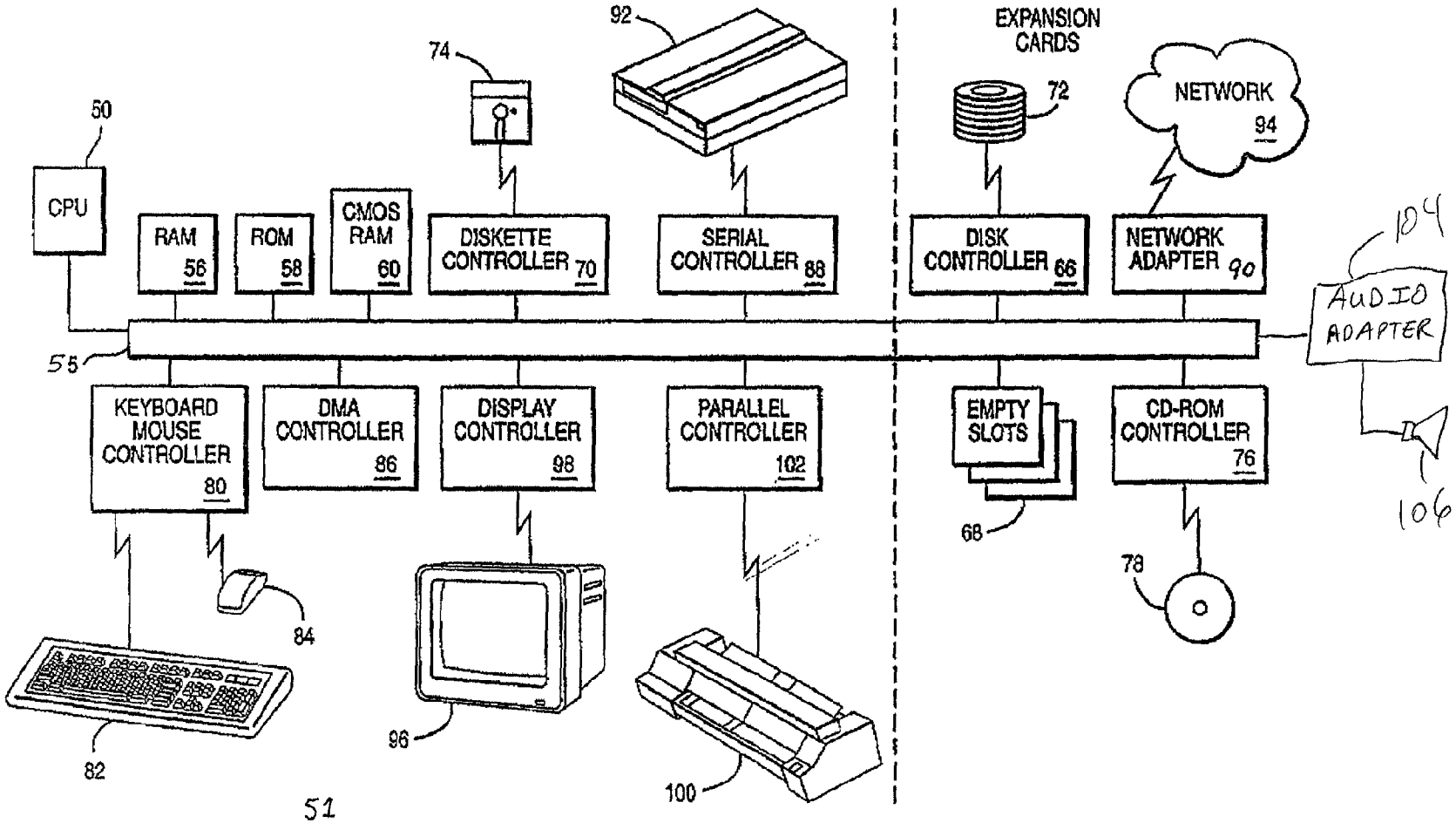
FIG. 5 is a block diagram of one embodiment of a computer system which can be used in conjunction with and/or to carry out one or more embodiments of the present invention.

With further reference to FIG. 5, the invention may also be implemented via software, and carried out on various data processing systems, such as computer system 51. In this embodiment, computer system 51 has a CPU 50 connected to a plurality of devices over a system bus 55, including a random-access memory (RAM) 56, a read-only memory (ROM) 58, CMOS RAM 60, a diskette controller 70, a serial controller 88, a keyboard/mouse controller 80, a direct memory access (DMA) controller 86, a display controller 98, and a parallel controller 102. RAM 56 is used to store program instructions and operand data for carrying out software programs (applications and operating systems). ROM 58 contains information primarily used by the computer during power-on to detect the attached devices and properly initialize them, including execution of firmware which searches for an operating system. Diskette controller 70 is connected to a removable disk drive 74, e.g., a 3½"floppy" drive. Serial controller 88 is connected to a serial device 92, such as a modem for telephonic communications. Keyboard/mouse controller 80 provides a connection to the user interface devices, including a keyboard 82 and a mouse 84. DMA controller 86 is used to provide access to memory via direct channels. Display controller 98 support a video display monitor 96. Parallel controller 102 supports a parallel device 100, such as a printer.

Computer system 51 may have several other components, which may be connected to system bus 55 via another interconnection bus, such as the industry standard architecture (ISA) bus, the peripheral component interconnect (PCI) bus, or a combination thereof. These additional components may be provided on "expansion" cards which are removably inserted in slots 68 of the interconnection bus. Computer system 51 includes a disk controller 66 which supports a permanent storage device 72 (i.e., a hard disk drive), a CD-ROM controller 76 which controls a compact disc (CD) reader 78, and a network adapter 90 (such as an Ethernet card) which provides communications with a network 94, such as a local area network (LAN), or the Internet. An audio adapter 104 may be used to power an audio output device (speaker) 106.

The present invention may be implemented on a data processing system by providing suitable program instructions, consistent with the foregoing disclosure, in a computer readable medium (e.g., a storage medium or transmission medium). The instructions may be included in a program that is stored on a removable magnetic disk, on a CD, or on the permanent storage device 72. These instructions and any associated operand data are loaded into RAM 56 and executed by CPU 50, to carry out the present invention. For example, a signal from CD-ROM adapter 76 may provide an audio transmission. This transmission is fed to RAM 56 and CPU 50 where it is analyzed, as described above, to calculate transform coefficients, predict favorable scalefactors, and calculate an appropriate total gain. These values are then used to quantize the transform coefficients and create an encoded bit stream. Computer system 51 can be used to create an encoded file representing an audio presentation by storing the successive encoded frames, such as in an MP3 file on permanent storage device 72; alternatively, computer system 51 can simply transmit the frames to other locations, such as via network adapter 90 (streaming audio).

Figure 6:
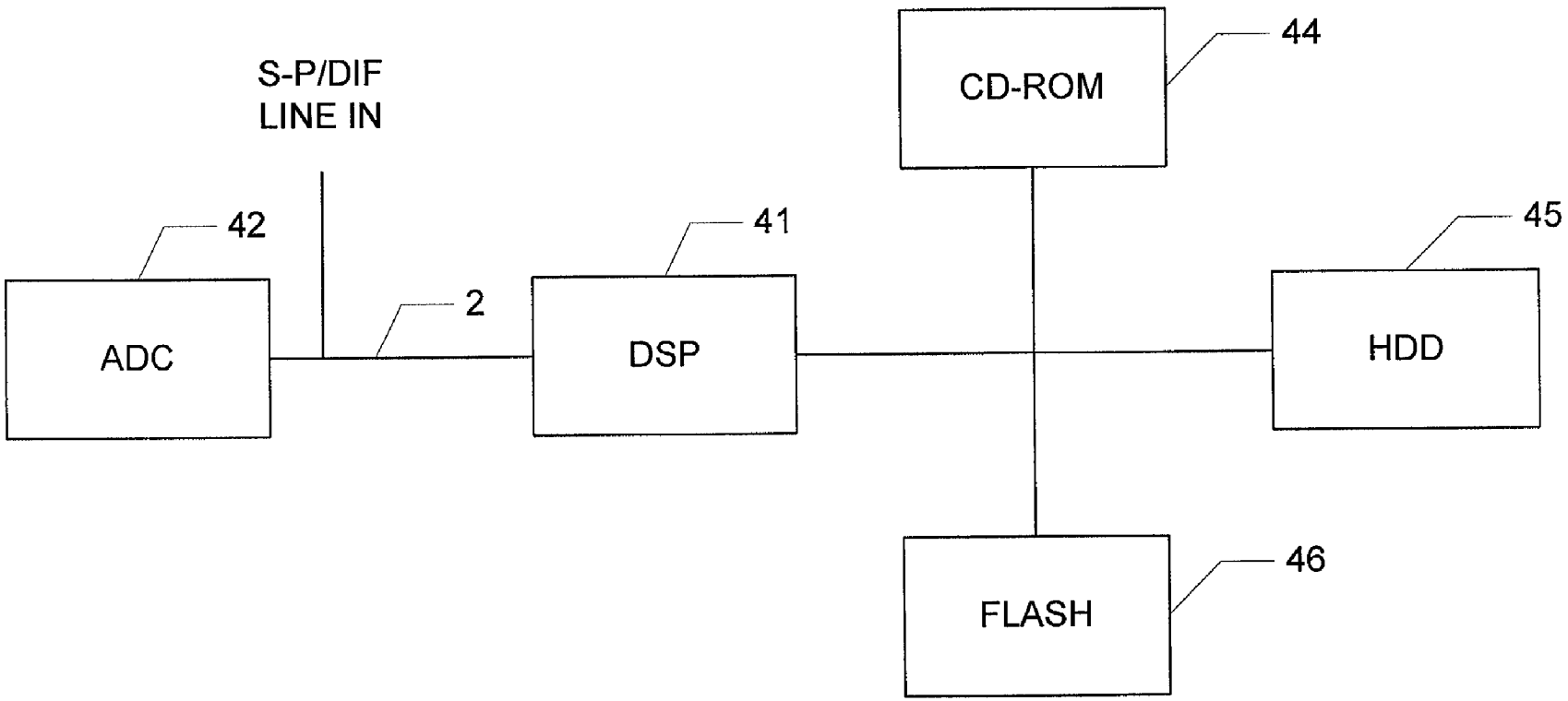
FIG. 6 is a block diagram of one embodiment of a digital signal processing system which can be used in conjunction with and/or to carry out one or more embodiments of the present invention.

Referring now to FIG. 6, the invention can be implemented in a digital signal processing system including digital signal processor (DSP) 41. In such implementations, DSP 41 is typically programmed to perform the encoding processes described in the context of FIGS. 3 and 4. Alternatively, the circuitry of DSP 41 can be specifically designed to perform the same tasks. In the implementation of FIG. 6, DSP 41 receives input signals from analog-to-digital converter (ADC) 42 and/or digital interface S-P/DIF port 43. The output of DSP 41 can be provided to a variety of devices including storage devices such as CD-ROM 44, hard disk drive (HDD) 45, or flash memory 46.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the invention. For example, while the invention has been discussed primarily in the context of audio data, those skilled in the art will appreciate that the invention is also applicable to visual data which may be compressed using a psychovisual model. It is therefore contemplated that such modifications can be made without departing from the spirit or scope of the present invention as defined in the appended claims.

What is claimed is:

1. A method of determining scalefactors used to encode a signal, comprising the steps of:

associating a plurality of distortion thresholds, respectively, with a plurality of frequency scalefactor bands of the signal;

transforming the signal to yield a plurality of sets of transform coefficients, one set for each of the frequency scalefactor bands; and calculating a plurality of total scaling values, one for each of the frequency scalefactor bands, such that an anticipated distortion based on the product of a transform coefficient for a given scalefactor band with its respective total scaling value is less than a corresponding one of the distortion thresholds; and wherein a given total scaling value $A_{sfb}$ for a particular frequency scalefactor band is calculated according to the equation:

$$A_{sfb}=2[4/(9BW_{sfb})]^{2/3}*(1/M_{sfb})^{2/3}*(\Sigma x_i)^{1/3},$$

where $BW_{sfb}$ is the bandwidth of the particular frequency scalefactor band, $M_{sfb}$ is the corresponding distortion threshold, and $\Sigma x_j$ is the sum of all of the transform coefficients for the particular scalefactor band.

2. The method of claim 1 wherein the signal is a digital signal, and further comprising the step of converting an analog signal to the digital signal.

3. The method of claim 1 wherein said associating step uses distortion thresholds which are based on psychoacoustic masking.

4. The method of claim 1 wherein said calculating step includes the steps of:

for a given frequency scalefactor band, obtaining a first term based on a corresponding distortion threshold; and obtaining a second term based on a sum of the transform coefficients.

5. The method of claim 4 wherein:

the first term is obtained from a first lookup table; and the second term is obtained from a second lookup table.

6. The method of claim 1, further comprising the steps of:

identifying one of the total scaling values as a minimum nonzero value; and normalizing at least one of the total scaling values using the minimum nonzero value, to yield a respective plurality of scalefactors, one for each scalefactor band.

7. The method of claim 6, further comprising the steps of:

setting a global gain factor to the minimum nonzero value; and re-quantizing the transform coefficients using the global gain factor and the scalefactors.

8. The method of claim 7, further comprising the steps of:

computing a number of bits required for said quantizing step; and comparing the number of required bits to a predetermined number of available bits.

9. The method of claim 8 wherein said comparing step establishes that the number of required bits is greater than the predetermined number of available bits, and further comprising the steps of:

reducing the global gain factor; and quantizing the transform coefficients using the reduced global gain factor and the scalefactors.

10. A method of encoding an audio signal, comprising the steps of:

identifying a plurality of frequency scalefactor bands of the audio signal;

associating a plurality of distortion thresholds, respectively, with the plurality of frequency scalefactor bands of the audio signal, the distortion levels being based on a psychoacoustic mask;

transforming the audio signal to yield a plurality of transform coefficients, one for each of the frequency scalefactor bands;

calculating a plurality of total scaling values, one for each of the frequency scalefactor bands, based on the distortion thresholds and the transform coefficients;

normalizing at least one of the total scaling values using a minimum nonzero one of the total scaling values, to yield a respective plurality of scalefactors, one for each scalefactor band;

setting a global gain factor to the minimum nonzero total scaling value;

quantizing the transform coefficients using the global gain factor and the scalefactors, to yield an output bit stream;

computing a number of bits required from said quantizing step;

comparing the number of required bits to a predetermined number of available bits; and packing the output bit stream into a frame; and wherein a given total scaling value $A_{sfb}$ for particular frequency scalefactor band is calculated according to the equation:

$$A_{sfb}=2[4/(9BW_{sfb})]^{2/3}*(1/M_{sfb})^{2/3}*(\Sigma x_i)^{1/3},$$

where $BW_{sfb}$ is the bandwidth of the particular frequency scalefactor band, $M_{sfb}$ is the corresponding distortion threshold, and $\Sigma x_i$ is the sum of all of the transform coefficients for the particular scalefactor band.

11. The method of claim 10 wherein said calculating step includes the step of obtaining a term from a lookup table based on a corresponding distortion threshold.

12. The method of claim 10 wherein said calculating step includes the step of obtaining a term from a lookup table based on a sum of the transform coefficients.

13. A device for encoding a signal, comprising:

means for associating a plurality of distortion thresholds, respectively, with a plurality of frequency scalefactor bands of the signal;

means for transforming the signal to yield a plurality of transform coefficients, one for each of the frequency scalefactor bands; and means for calculating a plurality of total scaling values, one for each of the frequency scalefactor bands, such that an anticipated distortion based on the product of a transform coefficient for a given scalefactor band with its respective total scaling value is less than a corresponding one of the distortion thresholds; and wherein a given total scaling value $A_{sfb}$ for a particular frequency scalefactor band is calculated according to the equation:

$$A_{sfb}=2[4/(9BW_{sfb})]^{2/3}*(1/M_{sfb})^{2/3}*(\Sigma x_i)^{1/3},$$

where $BW_{sfb}$ is the bandwidth of the particular frequency scalefactor band, $M_{sfb}$ is the corresponding distortion threshold, and $\Sigma x_i$ is the sum of all of the transform coefficients for the particular scalefactor band.

14. The device of claim 13, further comprising means for normalizing at least one of the total scaling values using a minimum nonzero one of the total scaling values, to yield a respective plurality of scalefactors, one for each scalefactor band.

15. An audio encoder comprising:

an input for receiving an audio signal;

a psychoacoustic mask providing a plurality of distortion thresholds, respectively, for a plurality of frequency scalefactor bands of the audio signal;

a frequency transform which operates on the audio signal to yield a plurality of transform coefficients, one for each of the frequency scalefactor bands; and a quantizer which calculates a plurality of total scaling values, one for each of the frequency scalefactor bands, such that an anticipated distortion based on the product of a transform coefficient for a given scalefactor band with its respective total scaling value is less than a corresponding one of the distortion thresholds; and wherein a given total scaling value $A_{sfb}$ for a particular frequency scalefactor band is calculated according to the equation:

$$A_{sfb}=2[4/(9BW_{sfb})]^{2/3}*(1/M_{sfb})^{2/3}*(\Sigma x_i)^{1/3},$$

where $BW_{sfb}$ is the bandwidth of the particular frequency scalefactor band, $M_{sfb}$ is the corresponding distortion threshold, and $\Sigma x_i$ is the sum of all of the transform coefficients for the particular scalefactor band.

16. The audio encoder of claim 15, wherein, for calculation of a total scaling value for a given frequency scalefactor band, said quantizer obtains a first term based on a corresponding distortion threshold, and obtains a second term based on a sum of the transform coefficients.

17. The audio encoder of claim 16 wherein:

the first term is obtained from a first lookup table; and the second term is obtained from a second lookup table.

18. The audio encoder of claim 15 wherein said quantizer normalizes all of the total scaling values using a minimum nonzero one of the total scaling values, to yield a respective plurality of scalefactors, one for each scalefactor band.

19. The audio encoder of claim 18 wherein said quantizer sets a global gain factor to the minimum nonzero value, and quantizes the transform coefficients using the global gain factor and the scalefactors.

20. The audio encoder of claim 19 wherein said quantizer further compares a number of bits required for said quantizing step to a predetermined number of available bits.

21. The audio encoder of claim 20 wherein said quantizer further reduces the global gain factor and quantizes the transform coefficients using the reduced global gain factor and the scalefactors, in response to a determination that the number of required bits is greater than the predetermined number of available bits.

22. A computer program product comprising:

a computer-readable storage medium; and program instructions stored on said storage medium for calculating a plurality of total scaling values associated with different frequency scalefactor bands of a signal, using transform coefficients of the signal and distortion thresholds for each frequency scalefactor band, such that the product of a transform coefficient for a given scalefactor band with its respective total scaling value is less than a corresponding one of the distortion thresholds; and wherein said program instructions calculate a given total scaling value $A_{sfb}$ for a particular frequency scalefactor band according to the equation:

$$A_{sfb}=2[4/(9BW_{sfb})]^{2/3}*(1/M_{sfb})^{2/3}*(\Sigma x_i)^{1/3},$$

where $BW_{sfb}$ is the bandwidth of the particular frequency scalefactor band, $M_{sfb}$ is the corresponding distortion threshold, and $\Sigma x_i$ is the sum of all of the transform coefficients for the particular scalefactor band.

23. The computer program product of claim 22 wherein said program instructions further carry out a frequency transform of the signal to yield the transform coefficients.

24. The computer program product of claim 22 wherein said program instructions further provide the distortion thresholds based on a psychoacoustic mask.

25. The computer program product of claim 22 wherein said program instructions calculate a total scaling value for a given frequency scalefactor band by obtaining a first term based on a corresponding distortion threshold, and obtaining a second term based on a sum of the transform coefficients.

26. The computer program product of claim 24 wherein said program instructions obtain the first term from a first lookup table, and obtain the second term from a second lookup table.

27. The computer program product of claim 22 wherein said program instructions further identify one of the total scaling values as a minimum nonzero value, and normalize all of the total scaling values using the minimum nonzero value, to yield a respective plurality of scalefactors, one for each scalefactor band.

28. The computer program product of claim 27 wherein said program instructions further set a global gain factor to the minimum nonzero value, and quantize the transform coefficients using the global gain factor and the scalefactors.

29. The computer program product of claim 28 wherein said program instructions further compute a number of bits required for said quantizing, and compare the number of required bits to a predetermined number of available bits.

30. The computer program product of claim 29 wherein said comparing establishes that the number of required bits is greater than the predetermined number of available bits, and said program instructions further reduce the global gain factor, and quantize the transform coefficients using the reduced global gain factor and the scalefactors.

* * * * *